United States Patent [19]

McMills et al.

[11] Patent Number: 4,639,068

[45] Date of Patent: Jan. 27, 1987

[54] HOLDER FOR COUPLING ASSEMBLY

[75] Inventors: Corey J. McMills, Los Altos; James C. Milroy, Palo Alto, both of Calif.

[73] Assignee: Raychem Corporation, Menlo Park, Calif.

[21] Appl. No.: 650,930

[22] Filed: Sep. 14, 1984

[51] Int. Cl.[4] ..... H01R 17/18

[52] U.S. Cl. ..... 339/177 R; 403/11

[58] Field of Search ..... 339/177, 119, 113 R; 403/11–14, 21; 29/281.1, 281.5, 283

[56] References Cited

U.S. PATENT DOCUMENTS

| | | | |
|---|---|---|---|
| 857,839 | 6/1907 | Sherman | 29/283 |
| 3,052,969 | 9/1962 | Loven | 29/281.1 |
| 3,136,843 | 6/1964 | Pomerantz et al. | 339/177 R |
| 3,241,224 | 3/1966 | Banister et al. | 29/281.1 |
| 3,550,064 | 12/1970 | Caller et al. | 339/177 R |
| 3,634,815 | 1/1971 | Stevens | 339/177 E |
| 3,728,769 | 4/1973 | Judge et al. | 29/281.5 |
| 3,836,700 | 9/1974 | Niemeyer | 174/89 |
| 3,963,320 | 6/1976 | Spinner | 339/177 R |

*Primary Examiner*—Gil Weidenfeld
*Assistant Examiner*—David Pirlot
*Attorney, Agent, or Firm*—Dennis E. Kovach; Herbert G. Burkard

[57] ABSTRACT

A holder for holding a coupling assembly useful for terminating a CATV coaxial cable includes first and second parallel, longitudinal grooves capable of retaining a plurality of connector bodies and driver members for facilitating assembly to a stripped coaxial cable end.

1 Claim, 5 Drawing Figures

HOLDER FOR COUPLING ASSEMBLY

BACKGROUND OF THE INVENTION

The present invention relates to a holder for holding a coupling assembly for terminating a coaxial cable, such as a CATV coaxial cable. The holder is particularly suited for holding a coupling assembly such as that described in co-pending U.S. Patent application Ser. No. 480,052 filed Mar. 29, 1983, assigned to the assignee of the present invention, the disclosure of which is incorporated herein by reference.

In the '052 application, there is disclosed a coupling assembly for terminating a CATV coaxial cable. Though the coupling assembly has several advantageous features not known in the prior art and results in a superior termination, a problem still exists in the field since assembly of the coupling assembly to a coaxial cable is often required to be done under extreme, adverse environmental conditions thereby inhibiting precise assembly of the coupling assembly.

SUMMARY OF THE INVENTION

Accordingly, it is an object of the present invention to provide a means for facilitating assembly of a coupling assembly to a coaxial cable to be terminated. This and other objects is achievable by the provision of a holder for holding a plurality of connector bodies and driver means required to terminate a coaxial cable, the holder providing a relatively large surface area for a craftsman to grip in the field under even extremely adverse environmental conditions such as snow, rain, high winds, etc., and the holder allows the craftsman to terminate the coaxial cable by simply inserting the coaxial cable through the driver means and then through the connector body, all while holding the holder, thus not requiring that the craftsman handle delicate little parts under conditions where it is possible that they cannot be correctly applied to the stripped coaxial cable end.

DESCRIPTION OF THE PREFERRED EMBODIMENTS

Figure 1:
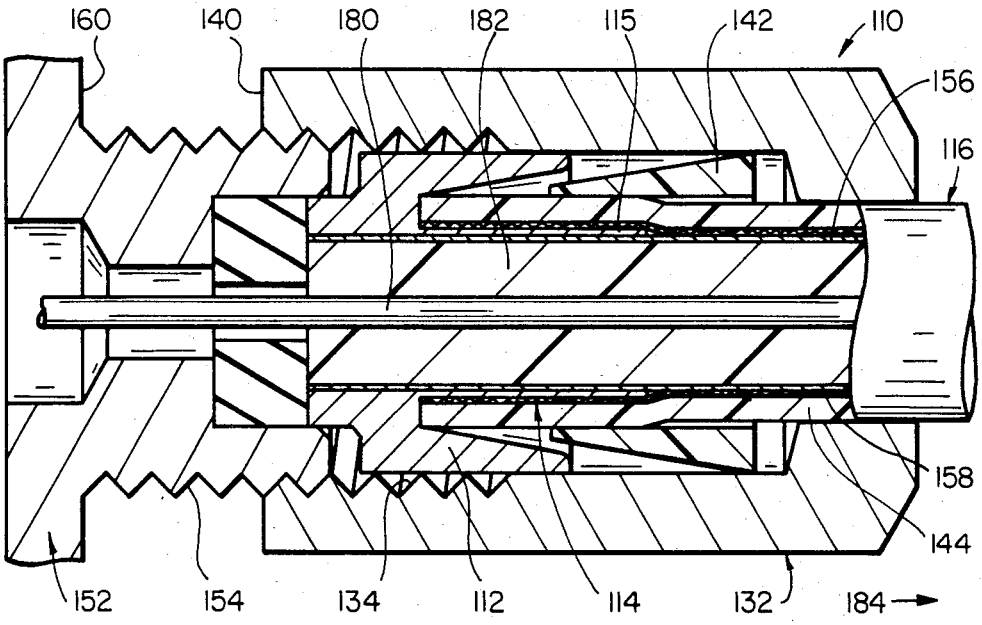
FIGS. 1 and 2 illustrate loosened and tightened positioned of a coupling assembly for which the holder of the present invention is particularly useful.
Figure 2:
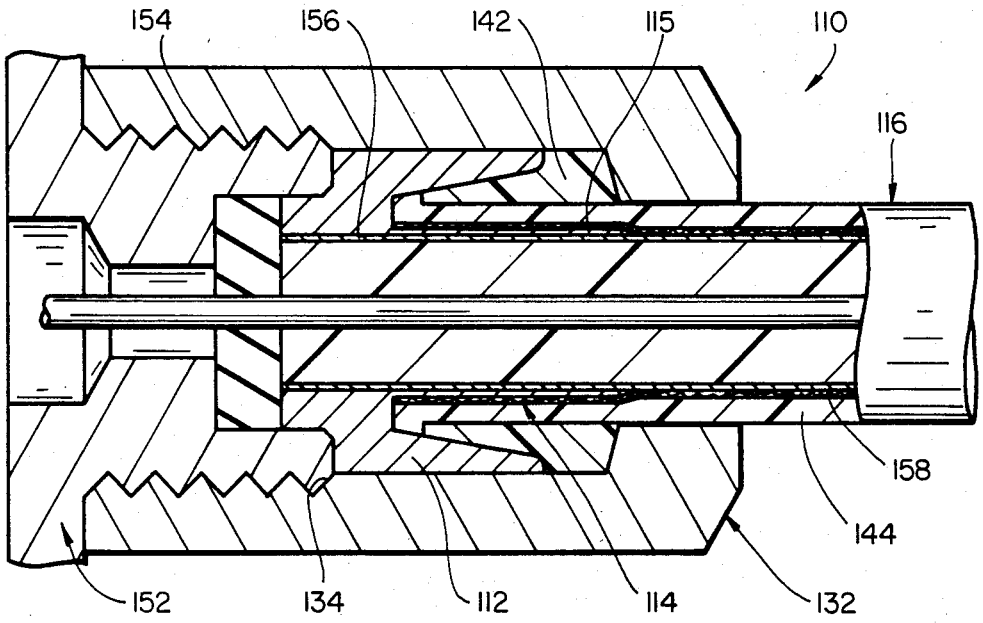

FIGS. 1 and 2 illustrate a coupler assembly usable with the holder of the present invention, the coupler assembly in FIG. 1 being illustrated in an untightened position whereas the assembly illustrated in FIG. 2 has been tightened by threading driver means 132 onto a wall unit 152 until face 140 engages face 160 so as to compress and deform a compressive member 142 against a coaxial cable protective jacket 144. This connector is commonly known as an "F-connector".

The F-connector 110 comprises the connector body 112 having a mating area 114, the driver means or member 132 having the threads 134, the rear face 140, and the compressive member 142. The connector 110 is connected to the wall mounting unit 152 e.g., a tap box in FIG. 1, through threads 154 which is typical for the coaxial cable type illustrated by reference 116.

For the type of cable illustrated, it is necessary to separate a delicate foil shielding 156 from braided layers 158. The connector body 112 includes the mating area 114 for contacting the braided layer and a distal end 115 which is sharpened to wedge between the delicate foil 156 and the braided layers 158. The sharpened, elongated end 115 of the connector body 112 provides a visual means for the craftsman to assure that the braided layer is in fact separated from the foil shield and is being properly positioned on the exterior of portion 115 of connector body 112, i.e., on the mating area 114, as the connector body 112 is being positioned on the cable 116.

In use, the driver means 132 is disposed around the cable 116 via an exposed end thereof which has previously been stripped by a stripping tool, preferably of the type described in an application entitled "Wire Stripping Tool" assigned to the assignee of the present invention and being filed concurrently herewith, the disclosure of which is incorporated herein by reference. Subsequently, the connector body 112 is inserted into stripped end of the coaxial cable 116 such that the mating area 114 is disposed between the braided layer 158 and the shield 156. Thereafter, the driver means 132 is slid over and around the connector body 112 and interconnected with the mounting unit 152 so as to deform the deformable member 142 as illustrated in FIG. 2.

In use, assembly complications oftentimes occur since the craftsman is required to strip the coaxial cable 116 and assemble the coupling assembly comprising the connector body 112 and the driver means 132 under adverse environmental conditions, and oftentimes the delicate assembly of the connector body and the stripped cable end is not performed correctly since it is a relatively sensitive job of insuring that the compressive member 142 is properly disposed between the shield and the braided layer 156 and 158 to the required depth, respectively.

Figure 3:
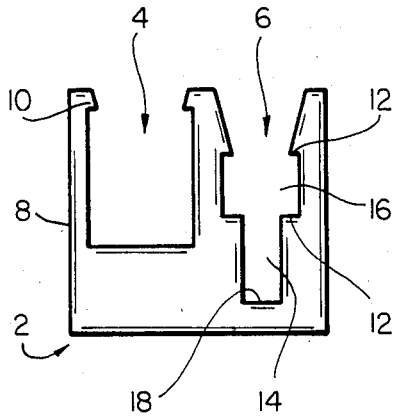
FIG. 3 is a plan view and FIG. 4 is a perspective view of a first embodiment of a holder of the present invention.
Figure 5:
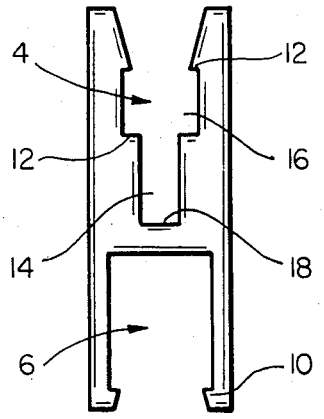
FIG. 5 is a plan view of a second embodiment of a holder of the present invention.
Figure 4:
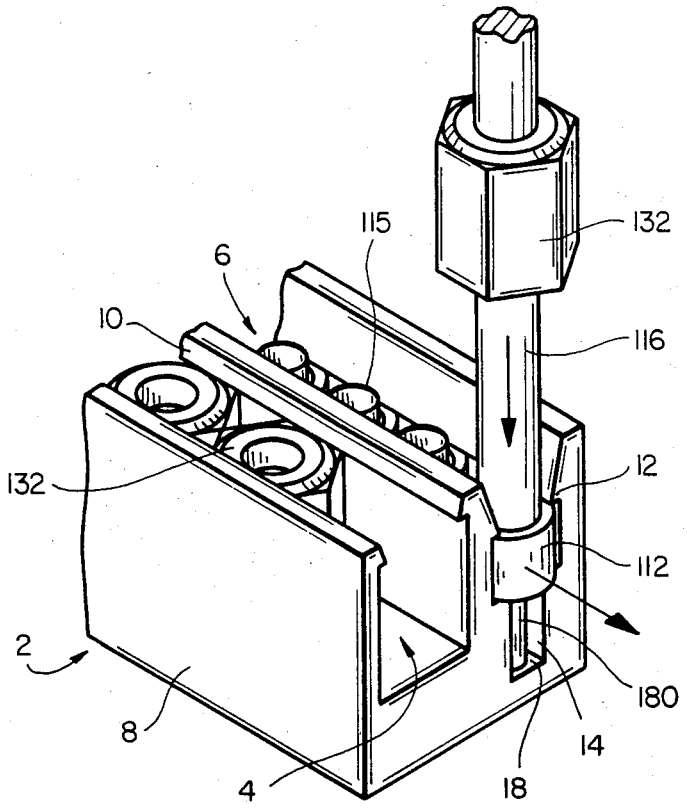

To eliminate these drawbacks, according to the present invention, a holder such as that illustrated in FIGS. 3 and 4, or alternatively a holder such as that illustrated in FIG. 5, results in the coupling assembly being easy to install with remarkably high reliability.

Referring in more detail to FIGS. 3 and 4, the holder 2 of the invention comprises a member 8 made of any suitable material, such as plastic, the member 8 having first and second longitudinal channels 4 and 6 formed therein. The first channel 4 has ridges 10 formed on upper ends thereof for slidably holding the driver means 132 illustrated in FIGS. 1 and 2. It will readily be appreciated that the channel 4 is capable of holding a plurality of these driver means.

Likewise, the member 8 further includes the second longitudinal channel 6 which is shaped so as to be capable of holding a plurality of connector bodies 112 in a slidable fashion, the ridges 12 being appropriately formed and spaced so as to retain the connector bodies 112. As can be appreciated from FIGS. 3 and 4, the ridges 12 together form a sliding channel for holding the connector bodies 112 and preferably the connector bodies 112 are retained by the ridges 12 in an attitude such that the portion 115 of the connector bodies 112 extend upwards. The second longitudinal groove 6 further includes a lower longitudinal recess 14 contiguous with a space 16 defined by the ridges 12. The depth of the recess 14 is designed such that a center conductor 180 of the stripped end of the coaxial cable 116 nearly touches a bottom face 18 of the recess 14 when the end of the coaxial cable has been properly inserted into the connector body 112 the required amount. Hence, visual inspection of the proper assembly of the connector body 112 to the stripped end of the coaxial cable is easily achievable. Furthermore, it is a simple task to assemble the connector body 112 to the stripped end of the coaxial cable 116 since the craftsman is not required to physically hold onto the relatively small connector body 112 since it is held in place by the ridges 12 of the member 8.

In use, to assemble a plurality of coupling assemblies of the type described to a like plurality of stripped ends of coaxial cables 116, the craftsman simply needs to pull out of his pocket the holder 2 of the invention having disposed within the first and second longitudinal channels the plurality of connector bodies 112 and driver means 132 described above. The craftsman then simply cuts first and second grooves in the end of the particular coaxial cable to be coupled with an appropriate stripping tool such as the tool described in the concurrently filed application cited above. Preferably, at this point, only the pierced outer jacket 144 of an outermost end of the cable 116 is removed and the braided layers so exposed are frayed outwards and backwards by any means. Most preferably, at this point, the craftsman does not remove the pierced portion of the dielectric 182 and metal shield 156.

Thereafter, the craftsman simply needs to insert the end of the coaxial cable 116 through driver means 132 located on an outermost end of the first groove 4 and slide this driver means out of the channel 4 and back over the coaxial cable 116 along a direction indictated by the arrow 184 in FIG. 1. Subsequently, the craftsman again inserts the end of the coaxial cable 116 into the second channel 6 so as to go through a connector body 112 located on either end of the second channel 6 while visually confirming that the sharpened, elongated portion 115 of the connector body 112 is inserted between the frayed and extended braids 158 and the shield 156. If the outermost pierced metal shield and dielectric have not been removed from the end of the cable 116 prior to this point, accurate insertion of the end of the coaxial cable to the connector body is facilitated. The end of the cable 116 is inserted into the second channel 6 such that it reaches a predetermined distance from the bottom face 18 of the groove portion 14 so that visual confirmation of a proper insertion amount of the connector body 112 is assured. Thereafter, the craftsman simply removes the pierced dielectric and shield from the end of the cable 116 and slides the driving means over the connector body and engages the driver means with the mounting unit 152.

Hence, it will be appreciated that assembly of the coupling assembly is greatly facilitated by the novel holder of the invention while at the same time allowing visual confirmation of the proper assembly thereof thus resulting in improved EMI and RFI shielding.

Though the invention has been described with respect to a preferred coupling assembly, it will be appreciated that the holder of the present invention is usable with other similartype coupling assemblies, and accordingly, the invention is only to be limited by the appended claims.

What is claimed is:

1. A kit of parts for connecting a coaxial cable, comprising:

a connector body having a mating area for engaging an outer layer of a cable and means for focussing the deformation of a deformable compressive member;

a driver member for interconnection with the connector body for compressing the compressive member between the driver member and the connector body;

a deformable compressive member adapted for positioning around the cable at the mating area and having sufficient compressive strength to deform the outer layer of a coaxial cable against the mating area of the connector body; and a holder for holding the connector body and the driver member, said holder having first and second longitudinal channels formed therein capable of holding a plurality of the driver members and connector bodies, respectively, in such a manner so as to allow the driver members and connector bodies to be longitudinally slid into and out of said respective channels and retained therein, said second longitudinal channel having first and second sets of ridges for retaining edges of upper and lower surfaces of the connector bodies, said second longitudinal channel further having a longitudinal recess extending from a lower one of the set of ridges therein for accommodating a stripped end of a coaxial cable when inserted through the connector body retained within the second channel so as to allow visual inspection of an insertion depth of the stripped end of the coaxial cable through the connector body.

* * * * *